US012247475B2

(12) United States Patent
Sahli et al.

(10) Patent No.: US 12,247,475 B2
(45) Date of Patent: Mar. 11, 2025

(54) AUTOMATED SLIDE DETECTION USING BOTH SURFACE TORQUE AND SURFACE RPM FOR DIRECTIONAL DRILLING APPLICATIONS

(71) Applicant: Schlumberger Technology Corporation, Sugar Land, TX (US)

(72) Inventors: Hussein Sahli, Houston, TX (US); Samba Ba, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/345,028

(22) Filed: Jun. 30, 2023

(65) Prior Publication Data

US 2024/0003239 A1 Jan. 4, 2024

Related U.S. Application Data

(60) Provisional application No. 63/367,340, filed on Jun. 30, 2022.

(51) Int. Cl.
*E21B 44/00* (2006.01)
*E21B 7/04* (2006.01)

(52) U.S. Cl.
CPC ..... *E21B 44/00* (2013.01); *E21B 7/04* (2013.01)

(58) Field of Classification Search
CPC ..... E21B 44/00; E21B 7/04
See application file for complete search history.

(56) References Cited

U.S. PATENT DOCUMENTS

2016/0305230 A1* 10/2016 Benson ..... E21B 47/12
2023/0279769 A1 9/2023 Ba

* cited by examiner

*Primary Examiner* — Dany E Akakpo
(74) *Attorney, Agent, or Firm* — Michael West

(57) ABSTRACT

A method includes receiving at least one drilling condition input from at least one sensor of a drilling rig, obtaining a first slide mode determination based at least partially on a rotational speed of a drill string, obtaining a second slide mode determination based at least partially on torque applied to the drill string, selecting one of the first or second slide mode determinations based on the at least one drilling condition input, determining that the drilling rig is in slide mode based on the selected one of the first or second slide mode determinations, calculating at least one steering parameter based at least in part on determining that the drilling rig is in slide mode, and executing at least one drilling operation based in part on the at least one steering parameter.

20 Claims, 7 Drawing Sheets

AUTOMATED SLIDE DETECTION USING BOTH SURFACE TORQUE AND SURFACE RPM FOR DIRECTIONAL DRILLING APPLICATIONS

CROSS-REFERENCE TO RELATED APPLICATIONS

This application claims priority to U.S. Provisional Patent Application having Ser. No. 63/367,340, which was filed on Jun. 30, 2022, and is incorporated herein by reference in its entirety.

BACKGROUND

In downhole drilling technology, directional drillers use various techniques and equipment to steer a drill bit along a non-vertical, potential tortuous, well trajectory. For example, the drillers may initiate a deviation or "kick off" the well, build angle, and drill tangent sections using mud motors. The mud motors may be used in two different modes: rotating and sliding. Rotating mode involves the drillstring rotating along with the drill bit, using the downhole motor. By contrast, sliding mode is performed by leveraging the mud motor to transform the hydraulic power into rotating power while the drillstring above the motor is fixed. Typically, the rotating mode is used to perform a straight drilling trajectory, and the sliding mode is used to steer the wellbore towards a certain path and drill curve sections. A bent shaft inside the mud motor generally provides the steering component to adjust the orientation of the drill bit, but other components have been used with varying degrees of success, as well.

After orienting the bend to a specific direction (toolface angle), and by not allowing drillstring rotation while drilling, slide mode drilling is triggered. However, many downhole drilling conditions affect slide performance such as the reactive torque, stalling of the mud motor, drilling through different formation, difficulties transferring weight to the bit, etc.

In general, directional drillers aim to maintain an acceptable rate of penetration (ROP), desired toolface (TF), and transfer weight to bit (WOB) without stalling the mud motor to maintain high drilling efficiency. As the hole depth increases, drillstring friction and drag also increase. This may change weight on bit (WOB); moreover, controlling TF performance may be affected, and this may reduce the ability to maintain sufficient ROP and trajectory to the target. To increase the efficiency of the transfer of weight, drillers may rock the pipe while sliding using different system.

When analyzing surveys, e.g., at points where steering/trajectory determinations are made, it may not be apparent from surface measurements whether the drilling is in slide mode or rotating mode. However, as noted above, determining which mode is active may be impactful on the TF orientation and steering determinations, which in turn may dictate the trajectory of the well and may ultimately impact the success of the operation. A variety of techniques have been proposed to determine the mode of drilling; however, within a single drilling operation, the different techniques may reach conflicting determinations about which mode is active. Furthermore, the data quality of the input to such techniques may be poor, which may further complicate the determination.

SUMMARY

An example of a method is provided. The method includes receiving at least one drilling condition input from at least one sensor of a drilling rig, obtaining a first slide mode determination based at least partially on a rotational speed of a drill string, obtaining a second slide mode determination based at least partially on torque applied to the drill string, selecting one of the first or second slide mode determinations based on the at least one drilling condition input, determining that the drilling rig is in slide mode based on the selected one of the first or second slide mode determinations, calculating at least one steering parameter based at least in part on determining that the drilling rig is in slide mode, and executing at least one drilling operation based in part on the at least one steering parameter.

An example of a computing system is provided. The computing system includes at least one processor, and a memory system comprising at least one non-transitory, computer-readable medium storing instructions that, when executed by the at least one processor, cause the computing system to perform operations. The operations include receiving at least one drilling condition input from at least one sensor of a drilling rig, obtaining a first slide mode determination based at least partially on a rotational speed of a drill string, obtaining a second slide mode determination based at least partially on torque applied to the drill string, selecting one of the first or second slide mode determinations based on the at least one drilling condition input, determining that the drilling rig is in slide mode based on the selected one of the first or second slide mode determinations, calculating at least one steering parameter based at least in part on determining that the drilling rig is in slide mode, and executing at least one drilling operation based in part on the at least one steering parameter.

An example of a non-transitory, computer-readable medium is provided. The medium stores instructions that, when executed by at least one processor, cause a computing system to perform operations. The operations include receiving at least one drilling condition input from at least one sensor of a drilling rig, obtaining a first slide mode determination based at least partially on a rotational speed of a drill string, obtaining a second slide mode determination based at least partially on torque applied to the drill string, selecting one of the first or second slide mode determinations based on the at least one drilling condition input, determining that the drilling rig is in slide mode based on the selected one of the first or second slide mode determinations, calculating at least one steering parameter based at least in part on determining that the drilling rig is in slide mode, and executing at least one drilling operation based in part on the at least one steering parameter.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
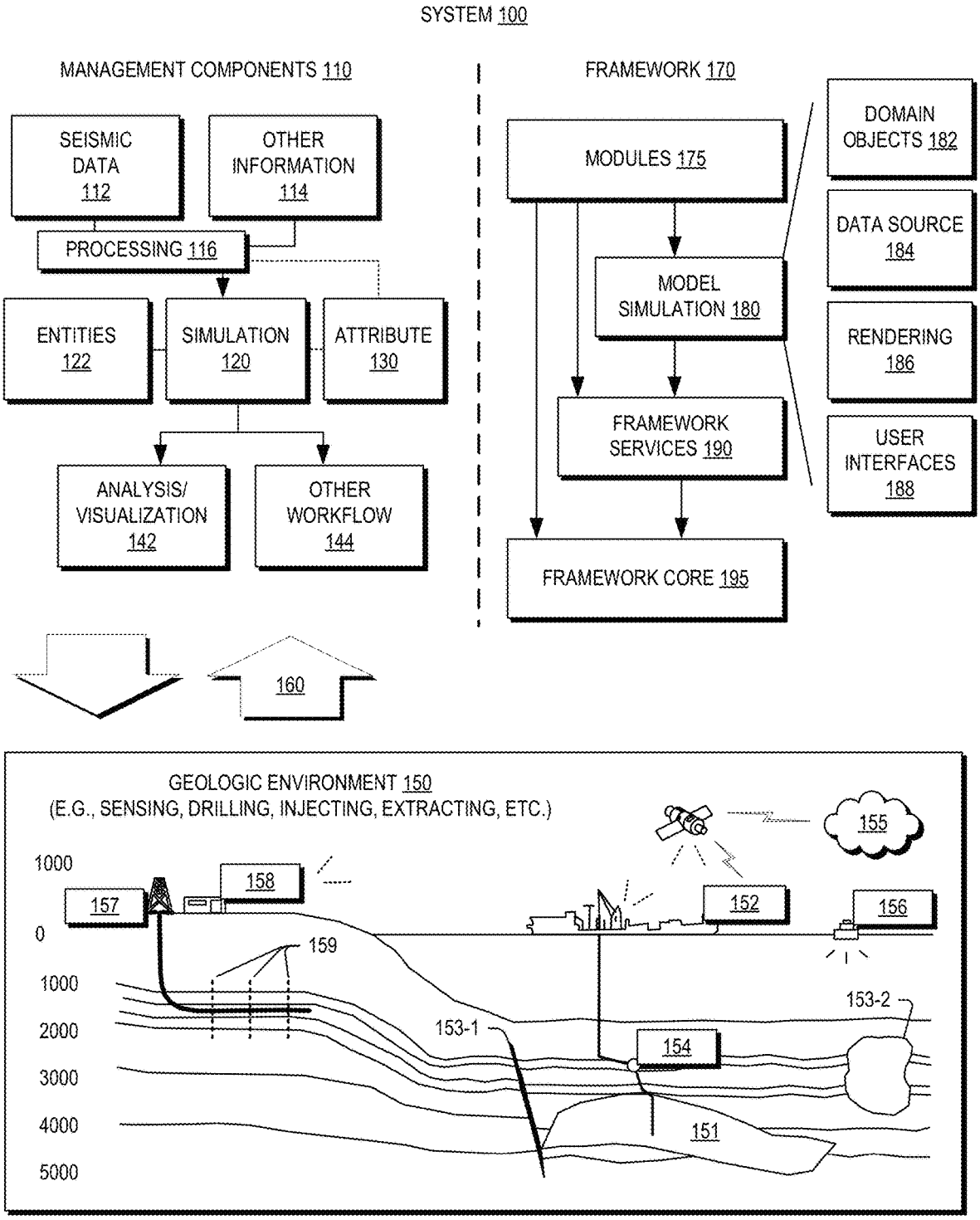
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122. Entities 122 may include earth entities or geological objects such as wells, surfaces, bodies, reservoirs, etc. In the system 100, the entities 122 may include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT® .NET® framework (Redmond, Washington), which provides a set of extensible object classes. In the .NET® framework, an object class encapsulates a module of reusable code and associated data structures. Object classes may be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (Schlumberger Limited, Houston Texas), the INTERSECT™ reservoir simulator (Schlumberger Limited, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (Schlumberger Limited, Houston, Texas). The PETREL® framework provides components that allow for optimization of exploration and development operations. The PETREL® framework includes seismic to simulation software components that may output information for use in increasing reservoir performance, for example, by improving asset team productivity. Through use of such a framework, various professionals (e.g., geophysicists, geologists, and reservoir engineers) may develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software may include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications may display their data while the user interfaces 188 may provide a common look and feel for application user interface components.

As an example, the domain objects 182 may include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project may be accessed and restored using the model simulation layer 180, which may recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Figure 2:
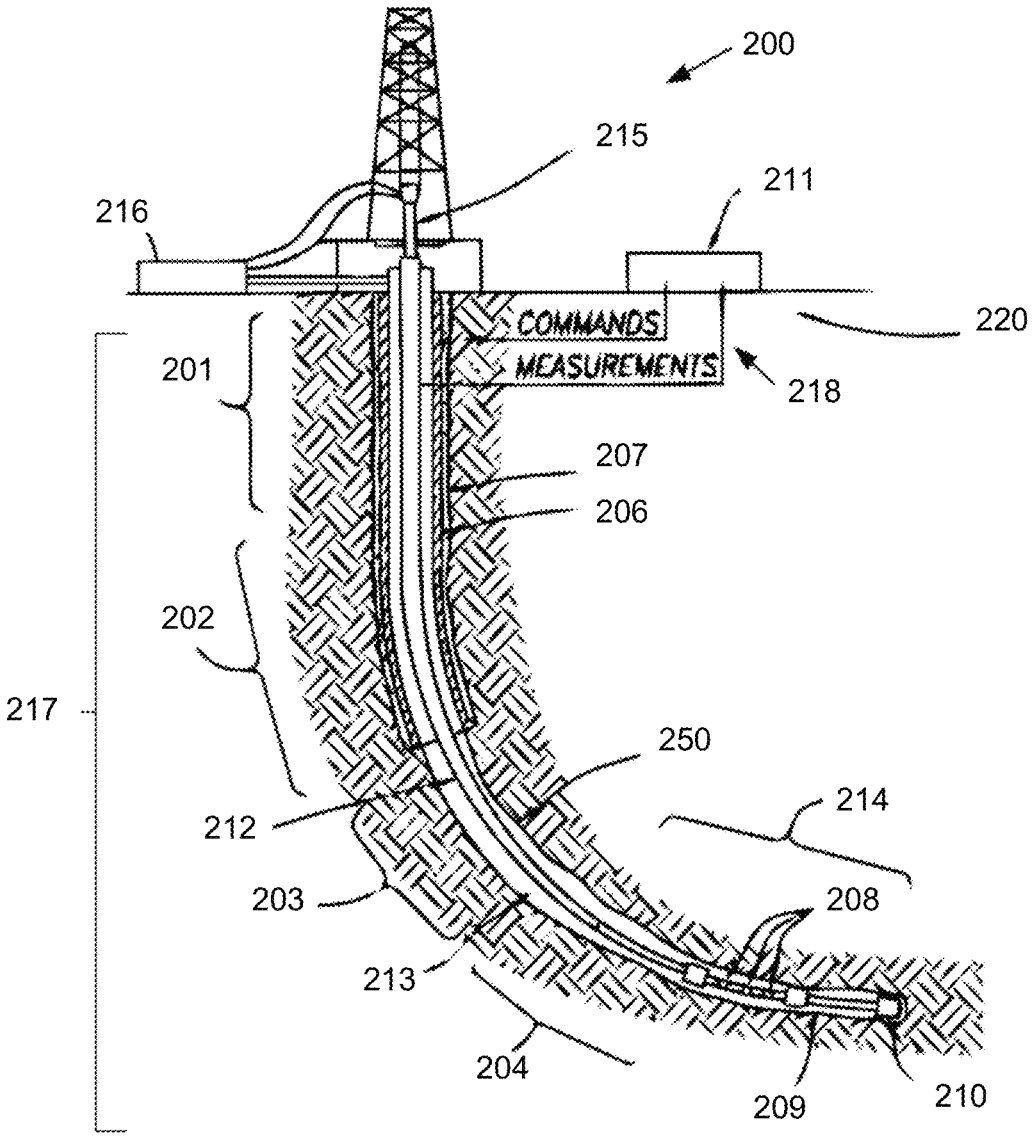
FIG. 2 illustrates a schematic view of a directional drilling system, according to an embodiment.

FIG. 2 illustrates a schematic diagram depicting an example of a drilling operation of a directional well in multiple sections. The drilling operation includes a wellsite drilling system 200 and a field management tool 220 for managing various operations associated with drilling a bore hole 250 of a directional well 217. The wellsite drilling system 200 includes components (e.g., drillstring 212, annulus 213, bottom-hole assembly (BHA) 214, kelly 215, mud pit 216, etc.). As shown in the example of FIG. 2, a target reservoir may be located away from (as opposed to directly under) the surface location of the well 217. In such an example, special tools or techniques may be used to ensure that the path along the bore hole 250 reaches the particular location of the target reservoir.

As an example, the BHA 214 may include sensors 208, a rotary steerable system 209, and a bit 210 to direct the drilling toward the target guided by a pre-determined survey program for measuring location details in the well. Although not shown, the drillstring 212 may also include a mud motor for rotating a distal portion of the drillstring 212 between the mud motor and the BHA 214, e.g., during slide mode drilling. Furthermore, the subterranean formation through which the directional well 217 is drilled may include multiple layers (not shown) with varying compositions, geophysical characteristics, and geological conditions. Both the drilling planning during the well design stage and the actual drilling according to the drilling plan in the drilling stage may be performed in multiple sections (e.g., sections 201, 202, 203 and 204) corresponding to the multiple layers in the subterranean formation. For example, certain sections (e.g., sections 201 and 202) may use cement 207 reinforced casing 206 due to the particular formation compositions, geophysical characteristics, and geological conditions.

A surface unit 211 may be operatively linked to the wellsite drilling system 200 and the field management tool 220 via communication links 218. The surface unit 211 may be configured with functionalities to control and monitor the drilling activities by sections in real-time via the communication links 218. For example, the surface unit 211 may determine steering commands and send these commands to the rotary steerable system 209 or another component of the BHA 214. The field management tool 220 may be configured with functionalities to store oilfield data (e.g., historical data, actual data, surface data, subsurface data, equipment data, geological data, geophysical data, target data, anti-target data, etc.) and determine relevant factors for configuring a drilling model and generating a drilling plan. The oilfield data, the drilling model, and the drilling plan may be transmitted via the communication link 218 according to a drilling operation workflow. The communication links 218 may include a communication subassembly.

To facilitate the processing and analysis of data, simulators may be used to process data. Data fed into the simulator(s) may be historical data, real time data or combinations thereof. Simulation through one or more of the simulators may be repeated or adjusted based on the data received. As an example, oilfield operations may be provided with wellsite and non-wellsite simulators. The wellsite simulators may include a reservoir simulator, a wellbore simulator, and a surface network simulator. The reservoir simulator may solve for hydrocarbon flowrate through the reservoir and into the wellbores. The wellbore simulator and surface network simulator may solve for hydrocarbon flowrate through the wellbore and the surface gathering network of pipelines.

Figure 3:
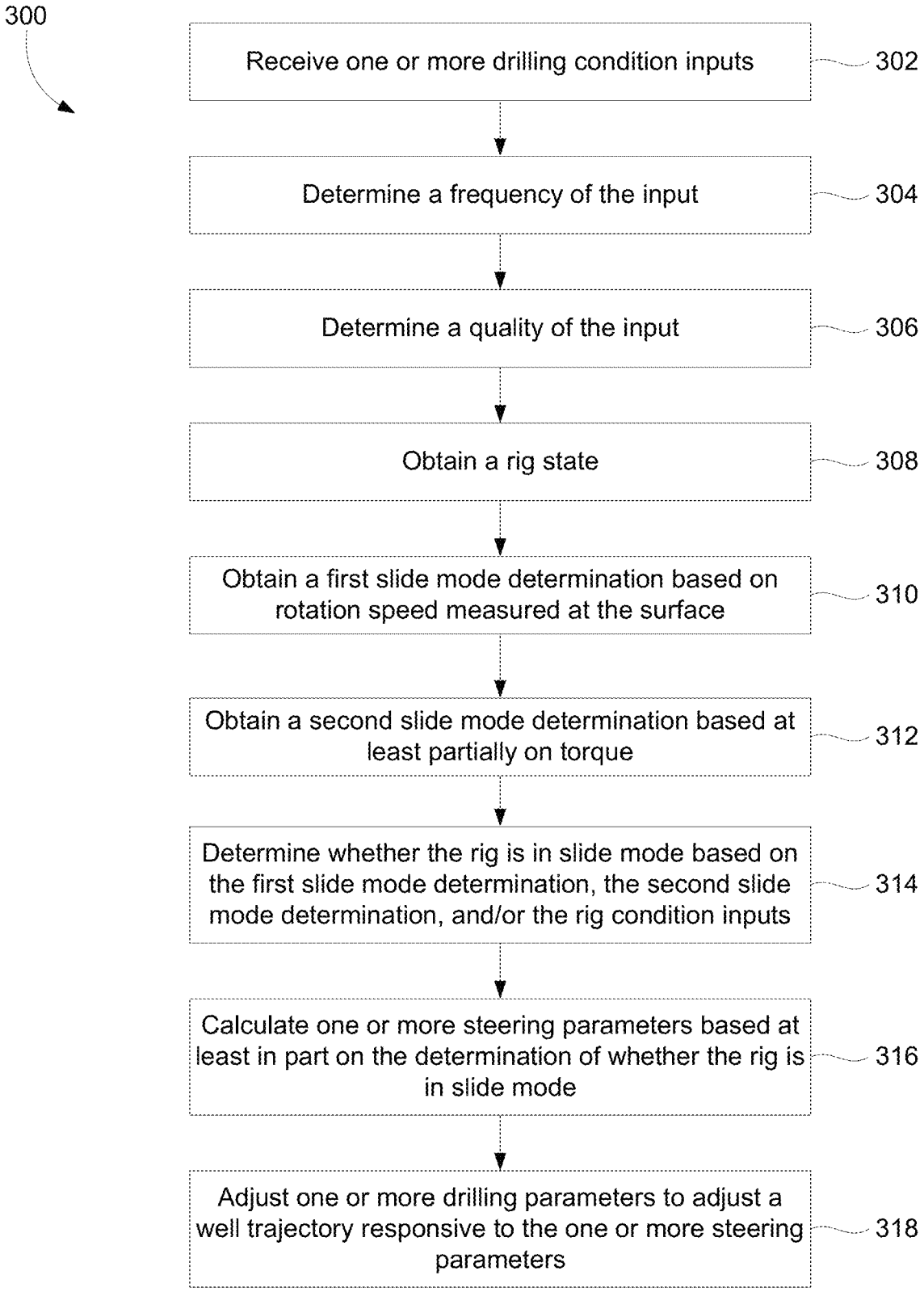
FIG. 3 illustrates a flowchart of a method for drilling a well, according to an embodiment.

FIG. 3 illustrates a flowchart of a method 300 for drilling, according to an embodiment. The method 300 may include receiving one or more drilling condition inputs at block 302. Such inputs may be measurements taken at a surface, or representative of downhole conditions, as measured by downhole sensors coupled to the BHA or elsewhere along the drill string, signals from which are transmitted to the surface via telemetry. Frequency and other quality-related measurements about the sensor measurements, e.g., those from the BHA or elsewhere downhole, may also be recorded and/or calculated. The drilling condition inputs may further include parameters based on surface measurements, such as speed (measured as revolutions per minute (RPM)), torque, weight on bit (WOB), rate of penetration (ROP), and rig state (e.g., slide mode or rotating mode drilling and/or rocking or not rocking).

The parameters may each be a series of data points taken over time, and thus may have a frequency associated therewith, which may be determined at block 304. In some cases, the frequency may be relatively high, e.g., more than about 0.5 Hz, 1 Hz, 2 Hz, 10 Hz, etc., but in other situations, the frequency may be relatively low, e.g., less than about 0.5 Hz, 1 Hz, 2 Hz, 10 Hz, etc. In particular, signals received from the BHA may be expected to be 1 Hz, but because of poor quality communication, noise, interference, equipment related conditions, etc., may have a frequency that is lower than the threshold.

Any threshold may be selected for determining that the frequency meets an expected threshold, and may be determined dynamically as part of the method 300 or predetermined. For example, statistical measurements related to signal frequency may be employed, such that a deviation from a mean or expected signal frequency may indicate a relatively low frequency. In a specific embodiment, the frequency of acquisition threshold may be a multiple of the characteristic frequency of the signal, e.g., three-times the characteristic frequency.

The method 300 may also include determining a quality of the drilling condition inputs, as at block 306. Such quality may be determined in a variety of ways, and such determination may consider whether the frequency is above the threshold, as noted above with reference to block 304. Additionally, the quality may consider missing data points. The quality may also consider repeated data points or invalid data. Repeated or invalid data points may be determined based on out-of-range values, statistically unlikely/impossible data values when viewed along with expected and/or other data point values in the series, associations with malfunctioning systems, etc.

The method 300 may also include obtaining a rig state, as at block 308. For example, the rig state may indicate in what mode the rig is operating nominally. For example, the rig state may indicate whether the rig is rocking the pipe, or whether slide mode or rotating mode drilling is active. Thus, the rig state itself may provide a "determination" of the drilling operations, but, in some situations, this determination may not be reliable, and thus other slide determinations may be considered.

The method 300 may also include obtaining a first slide mode determination based on rotation speed measured at the surface, at block 310. The first slide mode determination may be a binary value (e.g., true/false for whether slide mode is determined to be active). Rotation speed may be a direct measurement, e.g., received from rotating equipment such as a top drive, received from a mud motor downhole, received from a sensor in the drill string, a setting recorded in control equipment, etc. Based on the input quality and/or other factors as will be described herein, the first slide mode determination may not be the same as the rig state determination, and thus it may be unclear, from these determinations, whether the rig is in slide mode. Thus, another drilling mode determination may be considered in combination therewith.

The method 300 may include obtaining a second slide mode determination based at least partially on torque, at block 312. In some examples, the second slide mode determination may be made based on torque as well as any combination of rate of penetration (ROP), weight-on-bit (WOB), hookload, bottomhole pressure, pressure differential, pump flow rate, hook height, etc. Such factors may be employed to model the reactive torque, for example, that may come from the drillstring twisting during, e.g., the mud motor rotating the drill bit during slide mode drilling. Such parameters, including torque, may be drilling condition inputs, and may be measured directly in the BHA, mud motor, other rotating equipment, or in any other manner. The determination may be based on a drilling model, which may specify an expected torque (among other possibilities) given the drillstring's state, the formation properties, and the active mode (slide or rotating). This determination may confirm or disagree with the first determinations above for a given depth. In some embodiments, the method 300 may include performing the calculations and produce the second slide mode determination, e.g., based on a drilling model and considering the aforementioned parameters.

Accordingly, several signals may be available to combine and make a determination about the mode of drilling. These signals may be associated with one another e.g., by timestamps or drilling depths reached by the drill bit when the signals were captured. The signals (inputs and determinations) may then be combined, as explained below, to arrive at a composite drilling mode determination. Such composite determination may be arrived at when analyzing a survey or series of survey data points, e.g., to permit inferences about tool face orientation, steering efficiency, etc., between the discrete survey points, which may be separated apart by several meters in the well. Thus, a more accurate trajectory, between the survey points, may be determined, as the uncertainty of the drilling mode at different depths is reduced.

The method 300 may also include determining whether the rig is in slide mode based on the first determination, the second determinations, and/or the rig condition inputs, at block 314. In at least some examples, the composite determination at 314 may proceed according to the illustration provided in FIG. 4.

Figure 4:
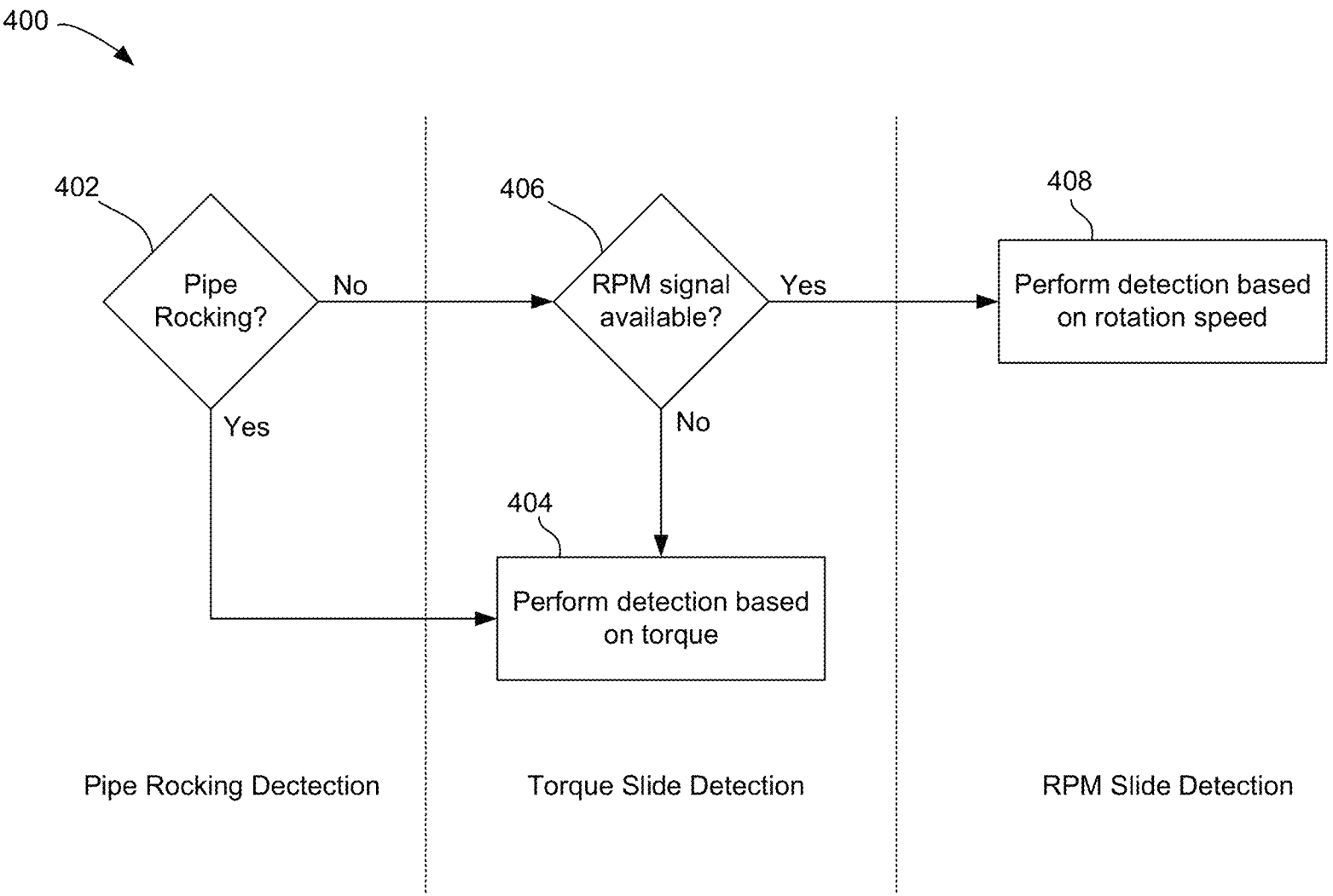
FIG. 4 illustrates a workflow for detecting slide mode drilling, e.g., as part of the method of FIG. 3, according to an embodiment.

In particular, FIG. 4 illustrates a workflow 400 for determining a drilling mode, according to an embodiment. The workflow 400 may represent a general case for the composite determination, and the method 300 may employ this workflow, but may also overrule the determination, e.g., based on the drilling conditions inputs, the frequency of the input, and/or the quality of the input, as will be explained below.

This workflow 400 may be performed automatically, e.g., by a processor reviewing survey data. The workflow 400 may include determining whether the pipe is rocking (e.g., torsionally or axially), at block 402. This may be a determination made based on input drilling conditions (e.g., surface measurements). If the pipe is rocking (bock 402: "Yes"), the workflow 400 may proceed to performing drilling mode detection based on torque (e.g., whether torque over a predetermined threshold value is used to determine whether slide mode or rotating mode drilling is active), e.g., by selecting and using the second slide mode determination, at block 404. Otherwise (block 402: "No"), the workflow 400 may proceed to determining whether a rotation speed (RPM) signal is available (and of sufficient quality), at block 406. If it is (block 406: "Yes"), the method 400 may perform detection based on rotation speed (e.g., selecting and using the first slide mode determination), at block 408. If it is not, then the torque signal is used, at block 404.

Referring again to FIG. 3, the composite determination at block 314 may generally proceed as indicated by the following table of examples:

TABLE 1

Metric comparison between torque-based slide detection (SD) ("Torque SD") and Speed-Based SD ("RPM SD")

| No # | Conditions | Rig State | RPM SD | Torque SD | Output |
|---|---|---|---|---|---|
| 1 | 1 Hz, No Rocking | True | True | True | Torque SD |
| 2 | <0.3 Hz, Rocking | False/ True | False | True | Torque SD |
| 3 | 1 Hz, Rocking, short period | False | True | True | Torque SD |
| 4 | <0.2 Hz, No Rocking | True | True | False | RPM SD |
| 5 | <0.2 Hz, Rocking | False | True | False | RPM SD |
| 6 | 1 Hz, No Rocking, Soft Torque | False | True | False | Torque SD |
| 7 | RPM < 10, No Rocking | True | True | False | Torque SD |

For example, considering case 1, and referring again to the workflow 400 of FIG. 4 and the method 300 of FIG. 3, the condition inputs show that the pipe is rocking (402: "Yes"). Further, the frequency meets the threshold (and/or other threshold quality measurements are met), which indicates that the measurements are being received with acceptable quality. As such, the torque-based slide detection is selected and used for the slide mode detection.

In the second case, the frequency is relatively low (e.g., poor data quality with the frequency below an expected threshold) and the rig state is rocking. In this case, the rig state determination is ambiguous/indeterminate, and the speed determination may be false, which disagrees with the torque-based determination of true. The torque-based slide detection is selected.

In case 5, the method 300 overrules the conclusion that would have been reached by the workflow 400 alone, because of the input signal quality. Specifically, in case 5, the input drilling conditions represent that the pipe is being rocked (402: "Yes"). In the workflow 400 of FIG. 4, this results in the torque-based slide detection (e.g., the second slide determination) being used. However, the frequency of the measurements, e.g., from the BHA and upon which the torque-based slide detection may be based, indicates that the input stream is of poor quality, e.g., below the frequency threshold of 1 Hz in this example. Thus, the torque-based detection may be unreliable and not used, and the speed-based slide detection is instead relied upon. Accordingly, in this case, the slide mode is determined as true, following the speed-based slide detection.

In cases 6 and 7, the second, torque-based slide detection is used, because the quality of the signal (e.g., frequency) is over the threshold and the pipe is not being rocked, e.g., following the workflow 400.

Referring specifically to FIG. 3, the method 300 may proceed to calculating one or more steering parameters based at least in part on the determination of whether the rig is in slide mode, at block 316. In other words, once the proper sliding interval and the proper rotating interval are calculated, the method 300 may calculate output parameters representing steering performance. Such parameters may include the average toolface, the toolface control, the slide efficiency factor, average rate of penetration, average weight on bit, average hook load, average RPM, average torque, etc. These parameters may then be used to execute one or more drilling operations. For example, the method 300 may include adjusting one or more drilling operations (e.g., equipment parameters), at block 318, by informing a drilling operator via a computer display, automatically (e.g., via a feedback control loop), or a combination thereof. The method 300 may also include sending a signal, e.g., from the surface unit 211 to one or more downhole components to adjust the trajectory of the well drilling.

Figure 5A:
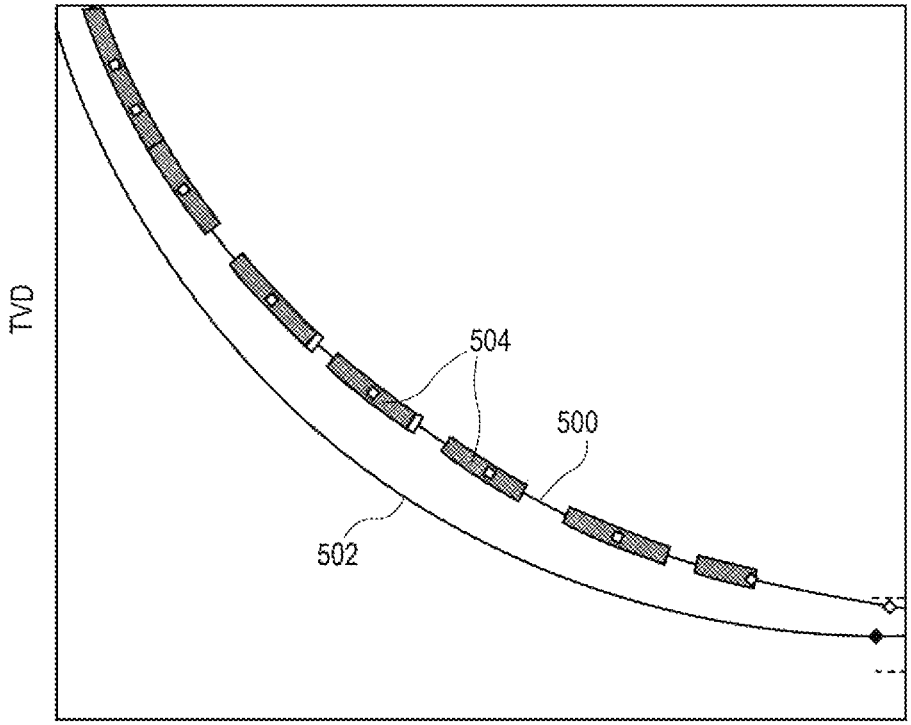
FIGS. 5A and 5B illustrates diagrammatic views of a well construction, according to an embodiment.
Figure 5B:
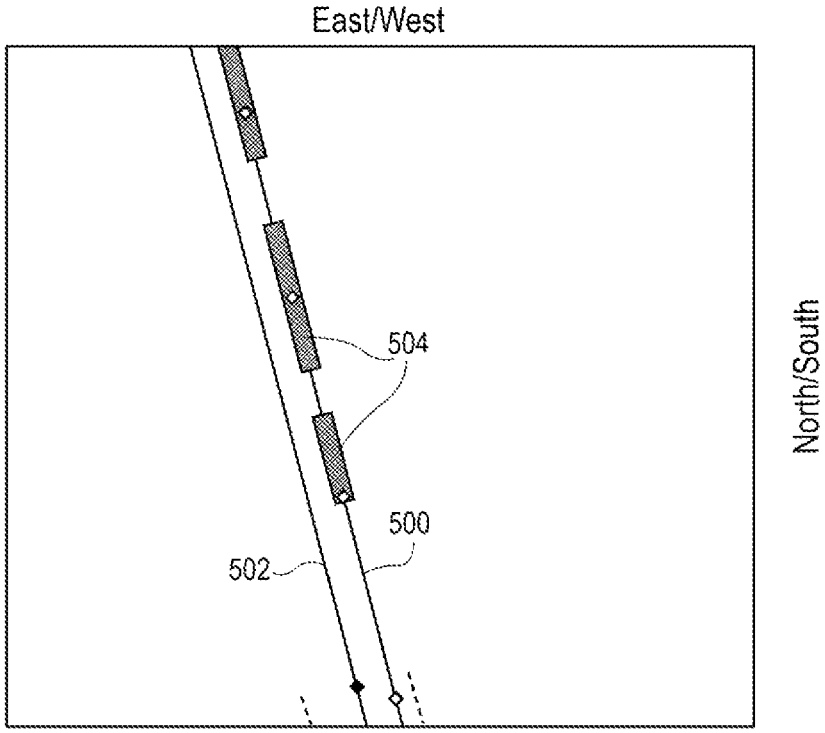

For example, referring to FIGS. 5A and 5B, two views, vertical and horizontal, respectively, of a well 500 are shown, along with a planned trajectory 502. In each view, slide mode is detected along several intervals 504. Thus, the different physical properties of slide mode, as opposed to rotating mode, are employed to analyze the steering and positioning of the well as the drill bit is advanced through these intervals 504, e.g., in order to effectively determine the actual trajectory. This permits steering parameters changes, e.g., to correct deviations from the planned trajectory, avoiding lowering the likelihood of a successful well drilling operation, hitting the target area, avoiding high dog leg severity, etc.

Accordingly, it will be appreciated that embodiments of the disclosure may provide a method of calculating motor sliding parameters such as average toolface, toolface control, slide efficiency, average rate of penetration, average weight on bit, average hook load, average rpm, average torque, etc. These values may be calculated during slide calculation when slide mode is active. Further, slide and rotating intervals may be detected automatically in real-time. Additionally, the confidence level of sliding by analyzing calculated toolface versus target toolface may be calculated. Such determination may permit more accurate steering of the drill bit and more accurate well drilling via modification of drilling (e.g., steering) parameters based on the slide mode data generated.

For example, the identification of a drilling mode (e.g., sliding or rotating) may be used to calculate and potentially improve steering efficiency factors (SEF) along various intervals, for example. SEF may be measured for individual depth intervals and may be calculated as a percentage, where higher SEFs correspond to a closer match between intended and measured toolface orientation. SEF measures a correspondence of steering commands to toolface orientation response, considering a time/depth interval.

The SEFs may measure system response to toolface orientation commands. For example, toolface orientation may be measured at survey points in a well, and commands may be provided at or between such survey points. The steering control system may send a toolface orientation command at the beginning of a window defined along the trajectory between two survey or other depth points. The SEF may represent the physical drilling system's response to the toolface orientation (steering) command, and may interpolate the SEF as between survey points, e.g., within a window. Further, one window may conclude and another may open, representing a change in toolface orientation (steering) commands, without the presence of a survey point.

Figure 6A:
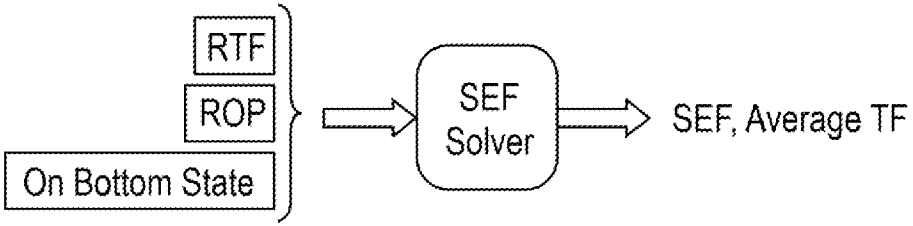
FIGS. 6A and 6B illustrate diagrammatic views of a steering efficiency factor (SEF) solver technique, according to an embodiment.
Figure 6B:
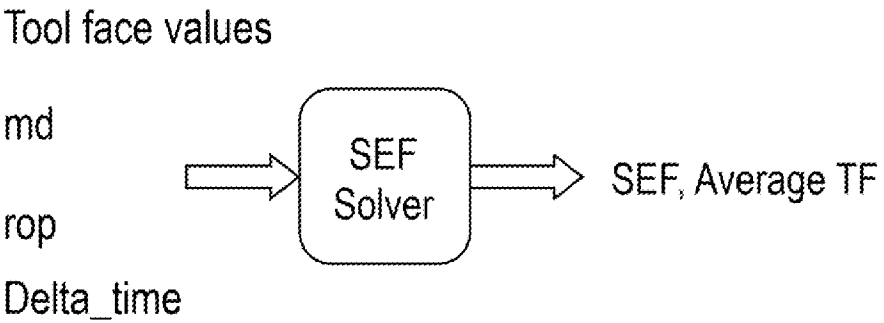
Figure 6B:
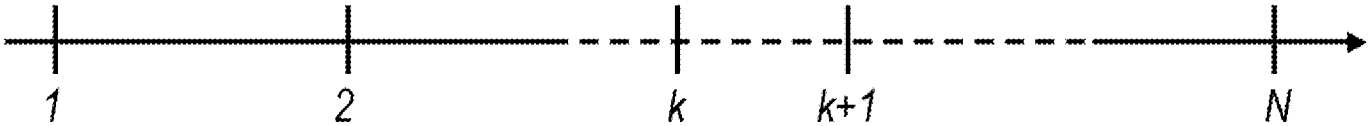

FIG. 6A illustrates a diagrammatic view of a SEF calculation technique for each window noted above. The window may include time and depth. SEF and average TF may be calculated from the survey points. Further SEF footage may be calculated from TF and footage (travel distance), which may be analogous to slide length. Neutral footage may be the depth minus the bias footage, which may be analogous to rotation length). The SEF calculation may receive, as input, RTF (realtime toolface) representing a realtime downhole measurement of the toolface, a rate of penetration, on-bottom state. In rotary operations, RTF may be converted to toolface orientation at every depth increment to obtain a high definition toolface. Additionally, as shown in FIG. 6B, the SEF solver may rely on toolface values, such as measured depth, rate of penetration, and time (e.g., from a previous point, delta-time) to compute this high definition toolface.

SEF may be interpolated between survey points and/or steering command points, which may be considered a virtual high-definition survey. This permits an estimation of the location and/or trajectory of the toolface between these points. As such, the SEF may provide a flag or other useful indication of the distance the toolface may be from a planned orientation. Corrective steering actions may then be taken to bring the toolface back to an orientation that moves the drill bit (or other part of the bottom-hole assembly (BHA)) back toward the desired track and/or to adjust steering commands based on poor responses.

With the implementation of a high definition SEF there may be sufficient accuracy to perform a projection of typical SEF to expect based on the past toolface control, the way the directional driller, the driller or the automation system is operating, the different formations, the toolface orientations, the context including the tool type, the section to be drilled, the mud conditions, the hole conditions etc.

Figure 7:
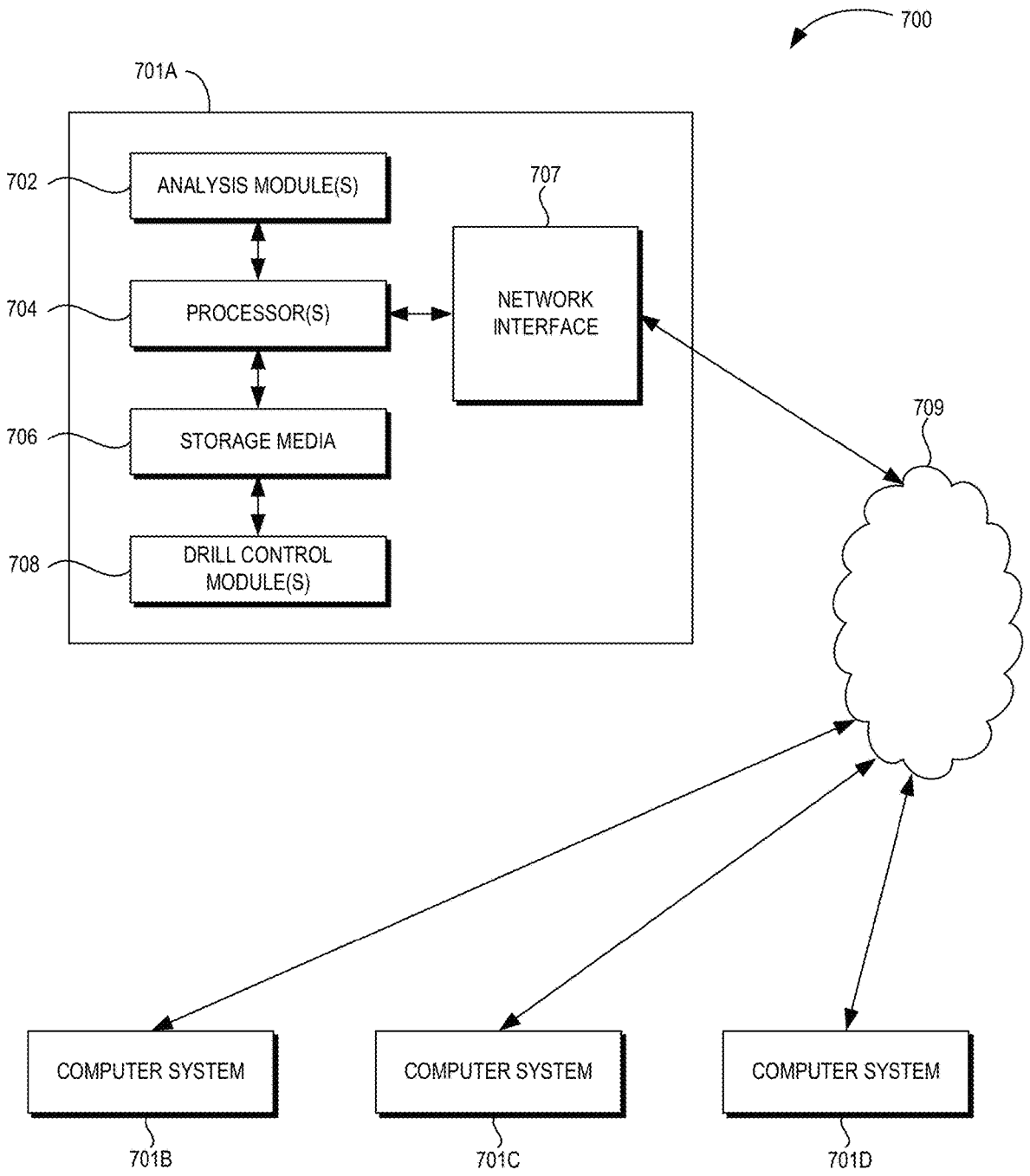
FIG. 7 illustrates a schematic view of a computing system, according to an embodiment.

In some embodiments, the methods of the present disclosure may be executed by a computing system. FIG. 7 illustrates an example of such a computing system 700, in accordance with some embodiments. The computing system 700 may include a computer or computer system 701A, which may be an individual computer system 701A or an arrangement of distributed computer systems. The computer system 701A includes one or more analysis modules 702 that are configured to perform various tasks according to some embodiments, such as one or more methods disclosed herein. To perform these various tasks, the analysis module 702 executes independently, or in coordination with, one or more processors 704, which is (or are) connected to one or more storage media 706. The processor(s) 704 is (or are) also connected to a network interface 707 to allow the computer system 701A to communicate over a data network 709 with one or more additional computer systems and/or computing systems, such as 701B, 701C, and/or 701D (note that computer systems 701B, 701C and/or 701D may or may not share the same architecture as computer system 701A, and may be located in different physical locations, e.g., computer systems 701A and 701B may be located in a processing facility, while in communication with one or more computer systems such as 701C and/or 701D that are located in one or more data centers, and/or located in varying countries on different continents).

A processor may include a microprocessor, microcontroller, processor module or subsystem, programmable integrated circuit, programmable gate array, or another control or computing device.

The storage media 706 may be implemented as one or more computer-readable or machine-readable storage media. Note that while in the example embodiment of FIG. 7 storage media 706 is depicted as within computer system 701A, in some embodiments, storage media 706 may be distributed within and/or across multiple internal and/or external enclosures of computing system 701A and/or additional computing systems. Storage media 706 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 700 contains one or more drill control module(s) 708. In the example of computing system 700, computer system 701A includes the drill control module 708. In some embodiments, a drill control calculation module may be used to perform some aspects of one or more embodiments of the methods disclosed herein. In other embodiments, a plurality of drill control modules may be used to perform some aspects of methods herein.

It should be appreciated that computing system 700 is merely one example of a computing system, and that computing system 700 may have more or fewer components than shown, may combine additional components not depicted in the example embodiment of FIG. 7, and/or computing system 700 may have a different configuration or arrangement of the components depicted in FIG. 7. The various components shown in FIG. 7 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 700, FIG. 7), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principles of the disclosure and its practical applications, to thereby enable others skilled in the art to best utilize the disclosed embodiments and various embodiments with various modifications as are suited to the particular use contemplated.

What is claimed is:

1. A method comprising:

receiving at least one drilling condition input from at least one sensor of a drilling rig, wherein the at least one drilling condition input has a frequency associated therewith;

obtaining a first slide mode determination based at least partially on a rotational speed of a drill string;

obtaining a second slide mode determination based at least partially on torque applied to the drill string;

selecting one of the first or second slide mode determinations based on the at least one drilling condition input, wherein selecting comprises:

determining whether a pipe is rocking based upon the at least one drilling condition input, wherein the pipe extends from the drilling rig into a well; and selecting the first slide mode determination in response to a determination that the pipe is not rocking and the frequency being greater than a threshold; or selecting the second slide mode determination in response to a determination that the pipe is rocking and/or a determination that the frequency is less than the threshold;

determining that the drilling rig is in slide mode based on the selected one of the first or second slide mode determinations;

calculating at least one steering parameter based at least in part on determining that the drilling rig is in slide mode; and executing at least one drilling operation based in part on the at least one steering parameter.

2. The method of claim 1, wherein the second slide mode determination is also selected based on a quality of the at least one drilling condition input.

3. The method of claim 2, wherein the quality comprises a number of missing or bad data points in the at least one drilling condition input.

4. The method of claim 2, wherein selecting the second slide mode determination is also based on hookload, weight-on-bit, rate of penetration, bottomhole pressure, pump flow rate, and pressure differential in combination with the torque.

5. The method of claim 1, wherein determining that the drilling rig is in slide mode comprises:

determining that the drill string is not rocking based at least in part on the at least one drilling condition input;

determining that a speed signal is available based at least in part on the at least one drilling condition input; and selecting the first slide mode determination based at least in part on determining that the drill string is not rocking, the speed signal is available, and a quality of the at least one drilling condition input.

6. The method of claim 5, wherein the quality comprises a number of missing or bad data points.

7. The method of claim 1, wherein calculating the at least one steering parameters comprises calculating a steering efficiency factor for at least one interval between downhole survey locations.

8. The method of claim 1, wherein executing the at least one drilling operation comprises sending at least one steering command to control equipment of the drilling rig based at least in part on the at least one steering parameter.

9. The method of claim 1, wherein executing the at least one drilling operation comprises sending at least one command to control a display of at least one steering parameter to a user to be followed.

10. The method of claim 1, further comprising generating a first graph showing a planned trajectory and an actual trajectory, wherein the actual trajectory is based upon the determination that the drilling rig is in slide mode.

11. The method of claim 10, wherein the actual trajectory comprises slide intervals when the drilling rig is in slide mode and non-slide intervals when the drilling rig is not in slide mode.

12. The method of claim 11, wherein the first graph is a vertical view, and further comprising generating a second graph showing the planned trajectory and the actual trajectory, wherein the second graph is a horizontal view.

13. A computing system, comprising:

at least one processor; and a memory system comprising at least one non-transitory, computer-readable medium storing instructions that, when executed by the at least one processor, cause the computing system to perform operations, the operations comprising:

receiving at least one drilling condition input from at least one sensor of a drilling rig, wherein the at least one drilling condition input has a frequency associated therewith;

obtaining a first slide mode determination based at least partially on a rotational speed of a drill string;

obtaining a second slide mode determination based at least partially on torque applied to the drill string;

selecting one of the first or second slide mode determinations based on the at least one drilling condition input, wherein selecting comprises:

determining whether a pipe is rocking based upon the at least one drilling condition input, wherein the pipe extends from the drilling rig into a well; and selecting the first slide mode determination in response to a determination that the pipe is not rocking and the frequency being greater than a threshold; or selecting the second slide mode determination in response to a determination that the pipe is rocking and/or a determination that the frequency is less than the threshold;

determining that the drilling rig is in slide mode based on the selected one of the first or second slide mode determinations;

calculating at least one steering parameter based at least in part on determining that the drilling rig is in slide mode; and executing at least one drilling operation based in part on the at least one steering parameter.

14. The computing system of claim 13, wherein the second slide mode determination is also selected based on a quality of the at least one drilling condition input.

15. The computing system of claim 14, wherein the quality comprises a number of missing or bad data points in the at least one drilling condition input.

16. The computing system of claim 14, wherein selecting the second slide mode determination is also based on hookload, weight-on-bit, rate of penetration, bottomhole pressure, pump flow rate, and pressure differential in combination with the torque.

17. The computing system of claim 14, wherein determining that the drilling rig is in slide mode comprises:

determining that the drill string is not rocking based at least in part on the at least one drilling condition input;

determining that a speed signal is available based at least in part on the at least one drilling condition input; and selecting the first slide mode determination based at least in part on determining that the drill string is not rocking, the speed signal is available, and a quality of the at least one drilling condition input.

18. The computing system of claim 17, wherein the quality comprises a number of missing or bad data points.

19. A non-transitory, computer-readable medium storing instructions that, when executed by at least one processor, cause a computing system to perform operations, the operations comprising:

receiving at least one drilling condition input from at least one sensor of a drilling rig, wherein the at least one drilling condition input has a frequency associated therewith;

obtaining a first slide mode determination based at least partially on a rotational speed of a drill string;

obtaining a second slide mode determination based at least partially on torque applied to the drill string;

selecting one of the first or second slide mode determinations based on the at least one drilling condition input, wherein selecting comprises:

determining whether a pipe is rocking based upon the at least one drilling condition input, wherein the pipe extends from the drilling rig into a well; and selecting the first slide mode determination in response to a determination that the pipe is not rocking and the frequency being greater than a threshold; or selecting the second slide mode determination in response to a determination that the pipe is rocking and/or a determination that the frequency is less than the threshold;

determining that the drilling rig is in slide mode based on the selected one of the first or second slide mode determinations;

calculating at least one steering parameter based at least in part on determining that the drilling rig is in slide mode; and executing at least one drilling operation based in part on the at least one steering parameter.

20. The medium of claim 19, wherein determining that the drilling rig is in slide mode comprises:

determining that the drill string is not rocking based at least in part on the at least one drilling condition input;

determining that a speed signal is available based at least in part on the at least one drilling condition input; and selecting the first slide mode determination based at least in part on determining that the drill string is not rocking, the speed signal is available, and a quality of the at least one drilling condition input, wherein the quality comprises a number of missing or bad data points.

* * * * *